United States Patent [19]

Lentz et al.

[11] Patent Number: 4,958,555

[45] Date of Patent: Sep. 25, 1990

[54] SIGHT PROOF, DRAINABLE BLADE LOUVER ASSEMBLY

[75] Inventors: Gary J. Lentz, Bradner; Michael J. Almaguer, Toledo, both of Ohio

[73] Assignee: Mestek, Inc., Westfield, Mass.

[21] Appl. No.: 425,699

[22] Filed: Oct. 23, 1989

[51] Int. Cl.[5] ..... F24F 13/08

[52] U.S. Cl. ..... 98/121.1; 52/473

[58] Field of Search ..... 52/473; 98/121.1, DIG. 9

[56] References Cited

U.S. PATENT DOCUMENTS

| | | | |
|---|---|---|---|
| 3,287,870 | 11/1966 | Johnson | 52/473 |
| 3,771,430 | 11/1973 | Lane | 98/121.1 |
| 4,064,670 | 12/1977 | Lichtenwald | 52/473 |
| 4,310,993 | 1/1982 | White | 98/121.1 X |
| 4,452,024 | 6/1984 | Sterriker et al. | 98/121.1 X |

*Primary Examiner*—Harold Joyce

*Attorney, Agent, or Firm*—Thomas A. Meehan

[57] ABSTRACT

A sight proof, drainable blade louver assembly for use in the wall of a building or other enclosure to permit outside air to enter the building, the louver having a plurality of spaced apart blades arranged between spaced apart vertical jambs of a frame in a vertical stack. Each blade has an upwardly inclined first portion and a second portion which is inclined downwardly from the first portion, thus giving each blade the configuration of an inverted V. The leading or free edge of the first portion has a vertical flange which extends upwardly partly to the blade thereabove, and a lip which extends obliquely from the free edge of the vertical flange partly back to the first portion. The free edge of the second flange has a vertical flange which extends downwardly therefrom partly to the blade therebelow. Each blade has a generally C-shaped projection which projects upwardly therefrom, from a location adjacent the juncture of the first and second portions of the blade, partly to the blade thereabove, the C-shaped projection having an opening which faces the inlet of the louver assembly. The jambs have inwardly facing channel portions which are aligned with the lowermost portion of the first portion of the blades for draining trapped liquid therefrom.

10 Claims, 2 Drawing Sheets

SIGHT PROOF, DRAINABLE BLADE LOUVER ASSEMBLY

BACKGROUND OF THE INVENTION

1. Field of the Invention

This invention relates to a louver assembly of the type which is installed in the wall of a building to permit ventilating air from the outside to enter the building. More particularly, this invention relates to a louver assembly which is sight proof, that is, which does not provide a clear line of sight therethrough to ensure the privacy of the occupants of the building, and which substantially prevents rain droplets entrained in air entering the louver from passing therethrough into the building.

2. Description of the Prior Art

U.S. Pat. Nos. 4,064,670 (R. A. Lichtenwald) and 3,287,870 (E. H. Johnson) describe louvers for mounting in the wall of a building or other enclosure to permit ventilating air from the outside to enter such building or enclosure. The louvers of these references include a vertical series of spaced apart blades which are upwardly inclined in the direction of flow and which are supported and retained in position by a generally rectangular frame. In the Lichtenwald reference, and to a lesser extent in the Johnson reference, the configuration of the blades, coupled with the inclination thereof, substantially blocks the flow of rain droplets through the louver and collects and drains the blocked rain. However, a substantially unimpeded, upwardly inclined line of sight exists through a louver of either of these references, and this is frequently objectionable on grounds of the privacy of the occupants of the building, especially when the louver is stationed near ground level, which is frequently the case. Of course, this problem can be partly or largely corrected by increasing the number of blades in a given louver, thereby reducing the spacing between adjacent louvers, but this would add to the original cost of the louver and would increase the air pressure drop across the louver, and both of these effects would be objectionable.

U.S. Pat. No. 3,771,430 (R. W. Lane) describes a drainable blade louver assembly which incorporates blades that are generally in the form of an inverted V. This louver assembly is not disclosed as being sight proof, and it relies heavily on a suspended, protruding extrusion at the outlet of each blade, which is not as effective as the inlet flange and lip of the Lichtenwald reference, to develop its asserted water removal characteristics.

SUMMARY OF THE INVENTION

According to the present invention there is provided a louver for the wall of a building, the louver having a vertical series of spaced apart blades and being highly effective in blocking rain droplets in outside air from passing therethrough, and collecting and draining the blocked rain. Each of the blades has a general configuration, in vertical cross-section, of an inverted V, with an upwardly first or inlet portion adjacent the outside face of the building which blocks, collects and drains substantially all rain droplets in outside air entering the louver, and with a downwardly facing outlet portion adjacent the outside wall on the inside of the building which retards a direct line of sight between such blade and the blade therebelow. Further, in a preferred embodiment, each blade is provided with an upwardly and outwardly facing C-shaped or L-shaped projection at or near the apex of the V, where the inlet portion and the outlet portion of the blade meet, to further trap any moisture droplets in the air which may reach such portion, whereby any such moisture will flow down the inlet portion, and to further obstruct a direct line of sight between such blade and the blade thereabove.

Accordingly, it is an object of the present invention to provide an improved louver assembly. More particularly, it is an object of the present invention to provide a louver assembly for use in the outside wall of a building which is effective in substantially preventing rain droplets in outside air entering the louver from passing therethrough into the building, and which does not provide a line of sight from the outside of the building into the building.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
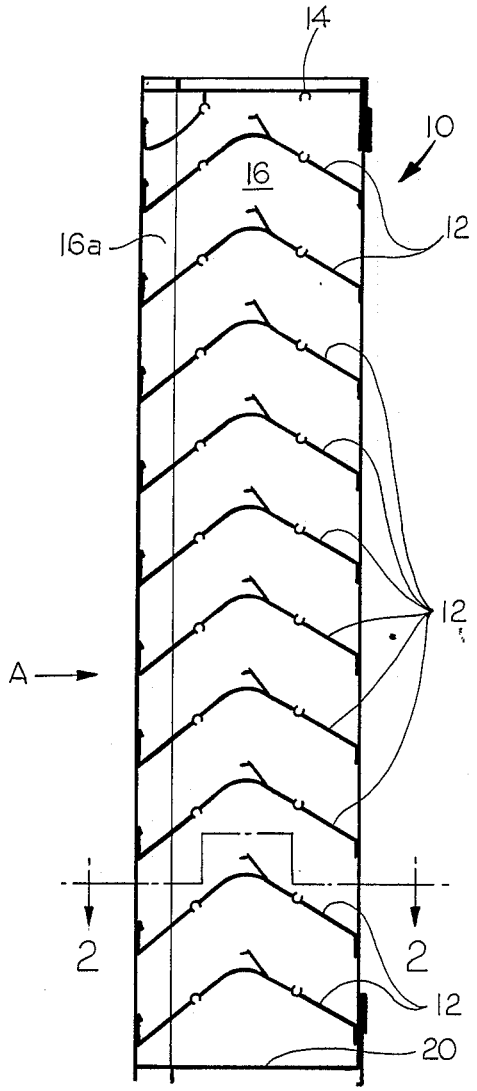
FIG. 1 is a vertical, cross-sectional view of a louver assembly according to the preferred embodiment of the present invention.
Figure 2:
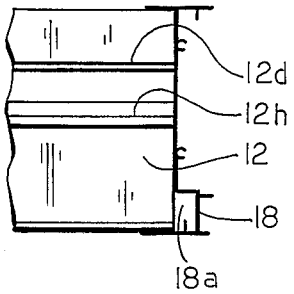
FIG. 2 is a fragmentary sectional view taken on line 2—2 of FIG. 1.
Figure 3:
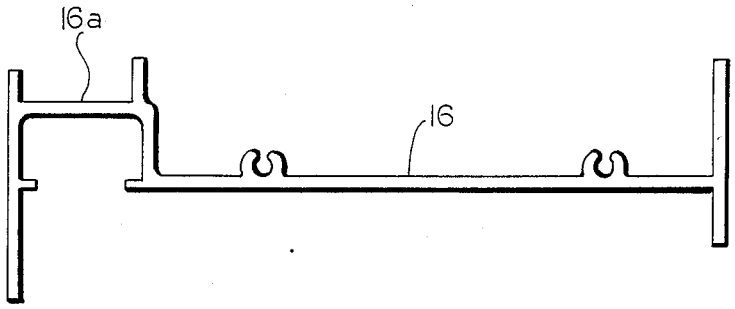
FIG. 3 is a plan view of a detail of the louver assembly of FIGS. 1 and 2.
Figure 4:
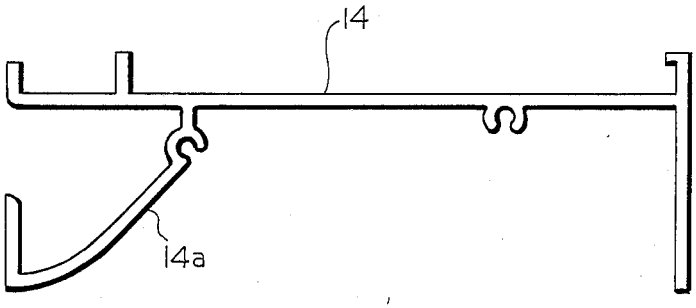
FIG. 4 is an elevational view of a detail of the louver assembly of FIGS. 1 and 2.
Figure 5:
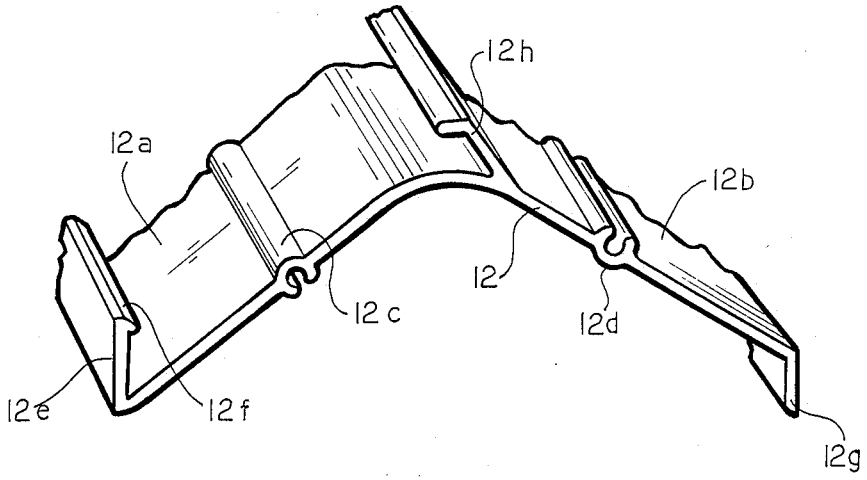
FIG. 5 is a fragmentary perspective view of a detail of the louver assembly of FIGS. 1 and 2.
Figure 6:
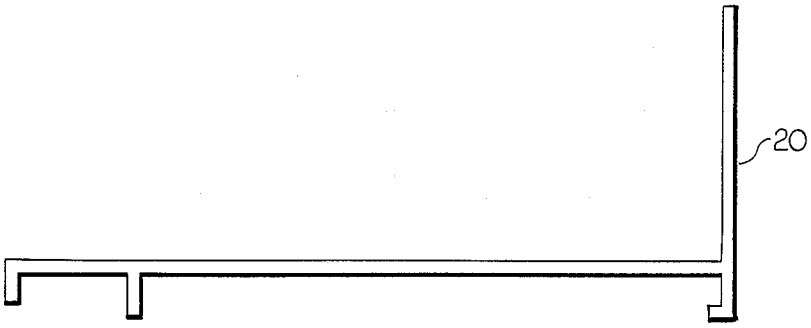
FIG. 6 is an elevational view of a detail of the louver assembly of FIGS. 1 and 3.

A louver assembly according to the present invention is indicated generally by reference numeral 10 in FIG. 1 and is designed to be inserted within an opening in a wall of a building to permit outside air to flow therethrough into the building, generally from left to right in the orientation of the louver assembly 10 in FIG. 1. The louver assembly 10 incorporates a plurality of blades 12 which are arranged in a vertical stack with adjacent blades 12 in the stack being uniformly spaced apart. The positioning of the blades 12 is accomplished by providing the louver assembly with a perimetrical frame which is made up of a horizontal header 14 and horizontally spaced apart and vertically extending jambs 16 and 18. The jamb 16 is illustrated in FIGS. 1 and 3 and the jamb 18, which is a right hand or mirror image version of the jamb 16, is illustrated fragmentarily in FIG. 2. The louver assembly 10 also included a sill 20 which extends horizontally below the header 14.

Each of the blades 12 is generally in the form of an inverted V in cross-section, having an inwardly and upwardly extending inlet portion **12*a* which is upstream with respect to the direction of flow through the louver assembly 10 and an outwardly and downwardly extending outlet portion 12*b* which is downstream with respect to the direction of flow through the louver assembly. Each of the blades 12, which can readily be manufactured in the illustrated, complex configuration by extrusion from a suitable material, for example, an aluminum alloy, such as grade 6063-T5 alloy, a material which is also useful in the manufacture, by extrusion, of the header 14, the jambs 16 and 18, and the sill 20. Each blade 12 is provided with a pair of spaced apart, generally C-shaped portions, 12*c* and 12*d*, in the inlet portion 12*a* and the outlet portion 12*b*, respectively, which are adapted to receive threaded fasteners, whereby each blade can be properly positioned relative to the jambs 16 and 18. Each of the blades 12 further has a vertically extending flange 12*e* extending upwardly from the inlet edge of the inlet portion 12*a* partly to the blade 12 which is spaced thereabove, and the flange 12*e* has a short lip 12*f* extending inwardly and downwardly therefrom, to assist in preventing moisture droplets entering the louver assembly 10 from passing therethrough, in the manner of the louver assembly of the aforesaid U.S. Pat. No. 4,064,670. The moisture which is removed from the air is collected in one or another of the horizontal V-shaped channels which are formed by each flange e and the respective inlet portion 12*a* of the blade 12, and is drained therefrom by one or another of the inwardly facing, vertically extending channel portions 16*a*, 18*a* of the jamb members 16, 18, respectively. Further, the outlet portion 12*b* of each blade 12 is provided with a downwardly extending flange portion 12*g* extending partly to the blade 12 therebelow to help stiffen the rear or outlet free edge of the blade 12. To simulate a blade at the top of the louver assembly 10, the header 14 is provided with a downwardly extending portion 14*a* which is similar in configuration to an inlet portion 12*a* of a blade 12. The downward orientation of outlet portion 12*b* of each of the blades 12 helps to block a direct line of sight through the louver assembly 10, for example, along the line indicated by the arrow A, especially if the outlet portion 12*b* of the blade 12 is provided with the flange 12*g*, depending on the spacing between adjacent blades 12. This is important to ensure the privacy of the occupants of a building containing the louver assembly 10, especially if it is placed at or near ground level, which is frequently the case. If it is desired to maintain a somewhat greater spacing between adjacent blades 12 than that which will ensure that no direct line of sight will exist through the louver assembly 10, the spacing between adjacent blades 12 can be increased by providing each blade 12 with an upwardly projecting generally C-shaped extension 12*h* near the juncture of the inlet portion 12*a* and the outlet portion 12*b*. The generally C-shaped extension 12*h* contributes to the blocking of a line of sight between the blade 12 which incorporates it and the blade 12 thereabove, thus permitting greater spacing between such blades, and by having the opening of the extension 12*h* facing to the inlet side of the louver assembly 10, the extension 12*h* will help to trap any moisture droplets which may have reached such location and return the moisture to the inlet side of the louver assembly 10 by virtue of the inclined orientation of the inlet portion 12*a* of the blade 12**.

Figure 7:
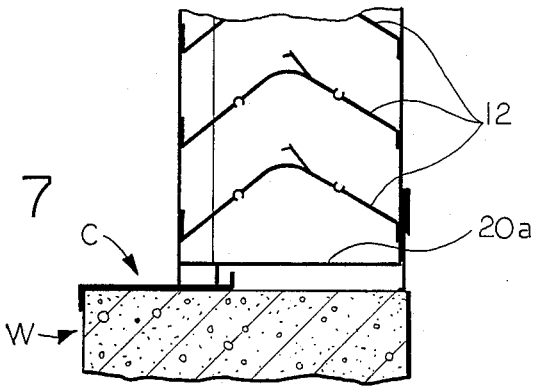
FIG. 7 is a fragmentary view similar to a portion of FIG. 1 but showing a modified embodiment of the present invention.

The louver assembly 10 which is illustrated in FIG. 1 is designed to be mounted in a building wall with the front of the louver being generally flush or slightly in front of the front face of the wall, thus facilitating the drainage of water which is trapped by the louver assembly 10. As is shown in FIG. 7, it is also possible to mount such a louver assembly inwardly of a wall, which is identified generally by reference character W, by utilizing a modified sill **20*a* which is spaced above a sill extension cap member C on the wall W to ensure the drainage of liquid from the louver assembly 10**.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A sight proof, drainable louver assembly for the flow of air therethrough from an inlet to an outlet, said louver assembly comprising:

a plurality of spaced apart louver blades, said blades being arranged in a generally vertically extending stack; and frame means surrounding and engaging said louver blades;

each of said louver blades having a configuration, in vertical cross-section, similar to an inverted V, with an inclined, first portion which extends upwardly in the direction of the flow of air through said louver assembly, and an inclined second portion which extends downwardly from said first portion in the direction of the flow of air through said louver assembly, said first portion having a flange portion which extends generally vertically upwardly from a leading edge thereof partly to the blade thereabove and a lip which extends inwardly and downwardly from a free, upper edge of said flange portion of said first portion partly to said first portion of said blade;

adjacent blades in said stack being spaced sufficiently closely to block a direct line of sight through said louver assembly.

2. A louver assembly according to claim 1 wherein said frame means comprises a pair of spaced apart, generally vertically extending jamb members, said blades being disposed between said jamb members, each of said jamb members having an inwardly facing channel-shaped portion aligned with said flange portion and a portion of said first portion of each of said blades which is adjacent to said flange portion for draining liquid which is trapped between said flange portion and said portion of said first portion.

3. A louver assembly according to claim 1 wherein said second portion of each of said blades has a flange portion extending vertically downwardly from the free edge thereof partly to the blade therebelow, said flange portion of said second portion of said each of said blades not being adapted to accumulate any substantial amount of liquid therein.

4. A louver assembly according to claim 1 wherein each of said louver blades is manufactured integrally in a single piece from an aluminum alloy by extrusion.

5. A louver assembly according to claim 3 wherein each of said louver blades is manufactured integrally in a single piece from an aluminum alloy by extrusion.

6. A sight proof, drainable louver assembly for the flow of air therethrough from an inlet to an outlet, said louver assembly comprising:

a plurality of spaced apart louver blades, said blades being arranged in a generally vertically extending stack; and frame means surrounding and engaging said louver blades;

each of said louver blades having a configuration, in vertical cross-section, in part which is similar to an inverted V, with an inclined first portion which extends upwardly in the direction of the flow of air through the louver assembly and an inclined second portion which extends downwardly from said first portion in the direction of the flow of air through said louver assembly, said first portion having a flange portion which extends generally vertically upwardly from a leading edge thereof and a lip which extends inwardly and downwardly from a free upper edge of said flange portion of said first portion partly to said first portion of said blade, each of said louver blades further having a portion which is generally C-shaped in cross-section which projects upwardly from said blade, at a location adjacent a juncture between said first portion and said second portion, partly to the blade thereabove, said C-shaped portion having an opening which faces the inlet of said louver assembly;

adjacent blades in said stack being spaced sufficiently closely to block a direct line of sight through said louver assembly.

7. A louver assembly according to claim 6 wherein said frame means comprises a pair of spaced apart, generally vertically extending jamb members, said blades being disposed between said jamb members, each of said jamb members having an inwardly facing channel-shaped portion aligned with said flange portion and a portion of said first portion of each of said blades which is adjacent to said flange portion for draining liquid which is trapped between said flange portion and said portion of said first portion.

8. A louver assembly according to claim 6 wherein said second portion of each of said blades has a flange portion extending vertically downwardly from the free edge thereof partly to the blade therebelow, said flange portion of said second portion of said each of said blades not being adapted to accumulate any substantial amount of liquid therein.

9. A louver assembly according to claim 6 wherein each of said louver blades is manufactured integrally in a single piece from an aluminum alloy by extrusion.

10. A louver assembly according to claim 8 wherein each of said louver blades is manufactured integrally in a single piece from an aluminum alloy by extrusion.

* * * * *